US007975356B2

(12) United States Patent
Schäfer et al.

(10) Patent No.: US 7,975,356 B2
(45) Date of Patent: Jul. 12, 2011

(54) MACHINE FOR THE PROCESSING OF OPTICAL WORK PIECES, SPECIFICALLY OF PLASTIC SPECTACLE LENSES

(75) Inventors: Holger Schäfer, Weilmünster (DE); Steffen Wallendorf, Giessen (DE)

(73) Assignee: Satisloh AG, Baar (CH)

( * ) Notice: Subject to any disclaimer, the term of this patent is extended or adjusted under 35 U.S.C. 154(b) by 630 days.

(21) Appl. No.: 12/217,434

(22) Filed: Jul. 3, 2008

(65) Prior Publication Data

US 2009/0011688 A1 Jan. 8, 2009

(30) Foreign Application Priority Data

Jul. 6, 2007 (DE) ..... 10 2007 031 703

(51) Int. Cl.
*B23P 23/00* (2006.01)
*B23Q 39/04* (2006.01)

(52) U.S. Cl. ..... 29/38 A; 29/38 B; 29/DIG. 86; 82/124; 82/129; 82/149; 409/134; 409/158; 409/161; 409/167; 409/168

(58) Field of Classification Search ..... 29/38 A, 29/38 B, 38 R, 563, 37 R, 36, 27 C, 27 R, 29/DIG. 56, DIG. 86, DIG. 94; 82/124, 125, 82/129, 149; 409/158, 161, 167–168, 173, 409/134
See application file for complete search history.

(56) References Cited

U.S. PATENT DOCUMENTS 4,520,595 A * 6/1985 Diener ..... 29/563
4,529,342 A * 7/1985 Babel ..... 409/164
4,829,716 A * 5/1989 Ueda et al. ..... 451/292
4,840,095 A * 6/1989 Nussbaumer et al. ..... 29/27 C
4,951,376 A * 8/1990 Grund ..... 29/563
5,058,261 A * 10/1991 Kitamura ..... 29/27 C
5,195,407 A * 3/1993 Takeno et al. ..... 82/118
5,205,076 A * 4/1993 Vernon et al. ..... 451/218
5,351,376 A * 10/1994 Kitamura ..... 29/27 C
5,525,096 A * 6/1996 Mayahara et al. ..... 451/277

(Continued)

FOREIGN PATENT DOCUMENTS

DE 19504368 A1 * 8/1996

(Continued)

OTHER PUBLICATIONS

DERWENT English language abstract for DE 19751750, which DE '750 was published Jun. 2, 1999.*

(Continued)

*Primary Examiner* — Erica E Cadugan
(74) *Attorney, Agent, or Firm* — Reising Ethington P.C.

(57) ABSTRACT

A machine for processing optical work pieces having a work piece spindle for the work piece driving rotationally about a work piece rotation axis. At least one processing unit has a tool that can machine the work piece and an adjusting mechanism causes a relative movement between the work piece spindle and tool to selectively enable loading, unloading and processing of the work piece. The adjusting mechanism has a linear drive unit and a swivel drive unit that are stacked on each other to rotate the swivel drive unit and the work piece spindle about a swivel axis that is perpendicular to the work piece rotation axis, and has the linear drive unit move the work piece spindle along a linear axis that can be perpendicular to one of the swivel axis and the work piece rotation axis and parallel to or aligned with the other axis.

19 Claims, 9 Drawing Sheets

U.S. PATENT DOCUMENTS

| | | | | |
|---|---|---|---|---|
| 5,815,902 | A * | 10/1998 | Osterried et al. | 29/38 A |
| 5,832,590 | A * | 11/1998 | Wuerthner | 29/563 |
| 5,938,381 | A | 8/1999 | Diehl et al. | |
| 5,951,376 | A | 9/1999 | Mandler | |
| 5,964,016 | A * | 10/1999 | Ito et al. | 29/27 C |
| 6,237,452 | B1 | 5/2001 | Ludwick et al. | |
| 6,523,443 | B1 * | 2/2003 | Hof et al. | 82/1.4 |
| 6,711,804 | B2 * | 3/2004 | Eicher | 29/563 |
| 6,991,525 | B2 | 1/2006 | Diehl et al. | |
| 7,036,408 | B2 | 5/2006 | Savoie et al. | |
| 7,278,192 | B2 | 10/2007 | Schaefer | |
| 7,367,929 | B2 * | 5/2008 | Feinauer et al. | 29/27 C |
| 2006/0086216 | A1 * | 4/2006 | Zuccalli | 82/124 |
| 2006/0253220 | A1 | 11/2006 | McPherson et al. | |
| 2006/0260447 | A1 | 11/2006 | Savoie et al. | |
| 2006/0260448 | A1 | 11/2006 | Fiedler et al. | |
| 2007/0094857 | A1 | 5/2007 | Savoie | |
| 2007/0277357 | A1 | 12/2007 | Meyer et al. | |
| 2007/0293128 | A1 | 12/2007 | Schafer et al. | |

FOREIGN PATENT DOCUMENTS

| | | | |
|---|---|---|---|
| DE | 197 51 750 | A1 | 6/1999 |
| DE | 10106189 | A1 * | 11/2001 |
| EP | 439425 | A1 * | 7/1991 |

OTHER PUBLICATIONS

Machine Translation of DE 19504368, which DE '368 was published Aug. 1996.*

* cited by examiner

MACHINE FOR THE PROCESSING OF OPTICAL WORK PIECES, SPECIFICALLY OF PLASTIC SPECTACLE LENSES

TECHNICAL FIELD

The present invention relates to a machine for the processing of optical work pieces and in particular to the industrial manufacture of prescription surfaces of spectacle lenses made of plastic materials such as polycarbonate, CR39 and so called "High Index" materials.

BACKGROUND OF THE DISCLOSURE

Typically, in the manufacturing of plastic spectacle lenses, a spectacle lens blank produced by injection molding of plastic, also known as a "blank", is used, that has a standardized finished outer surface with a convex shape, for example a spherical or progressive shape. The outer shape in conjunction with the usually concave inner or prescription surfaces produce a desired optical effect by attaining a machined spherical, aspherical, torical, atorical, progressive or free-form geometry (e.g. varifocal lenses). After blocking the spectacle lens blank with its outer surface onto a block piece, the typical conventional procedure for the processing of the inner surface includes, a milling or lathe process for the production of the optically active shape, in general followed by a fine grinding or polishing process in order to achieve the necessary surface quality.

Suggestions for the manufacture of the optically active shape of plastic spectacle lenses have included pure milling machines, specifically for the rough processing of the spectacle lenses; pure fast-tool lathes with a lathe tool that can be highly dynamically moved for the fine processing of the spectacle lenses, either by linear reciprocation or rotation so that lens surfaces not symmetrical with respect to rotation can be generated in the lathe process; and also combined milling and lathe machines with a combined milling and lathe tool; or separate milling and (linear or rotary working) lathe units. The spectacle lenses can be processed either in series with one and the same spectacle lens is milled and subsequently lathe machined in the work space of the machine or parallel where different spectacle lenses are worked on at the same time in the work space of the machine, in which one is milled and the other is lathe machined.

A series working combined milling and lathe machine is known from the state of the art that includes in general the following subassemblies: a work piece spindle that rotatably drives the work piece about a work piece rotation axis, at least one processing unit that has a tool that machines the work piece that is retained on the work piece spindle; and an adjusting mechanism that generates a relative movement between the work piece spindle and the tool, in order to enable either loading, unloading or processing of the work piece.

More accurately, the known machine has a milling unit with a milling spindle and a lathe unit with two fast-tool arrangements in parallel arrangement on one side of a work space. The adjusting mechanism that is provided on the opposite side of the work space. The adjusting mechanism is formed by a cross slide arrangement that supports the work piece spindle. The work piece spindle can move the work piece relative to the processing units in a parallel direction along an X-axis and in a towards and away direction along a Y-axis. Admittedly, this machine concept has proven itself already in practice and is on the market under the name VFT Ultra, produced by Satisloh AG.

In the manufacturing of plastic spectacle lenses according to prescription, considerable parts of the work piece are machined while supplying large amounts of coolant, which makes it essential to isolate or enclose the work space sufficiently and to ensure unhindered removal of waste chips. In addition, unpleasant vapors may be formed during the machining of certain high index materials that should be removed by suction and filtered.

A stainless steel shield is provided in the above described machine to shield against spray and for providing encapsulation of the work space. The shield is relatively large and expensive because the X-axis is relatively long and the shield casing has to accommodate the movement of the work piece spindle along the long X-axis. An elongated opening is provided in the shield casing to accommodate the motion and access to the work piece spindle. This opening is closed by a combined slide and roll cover that cooperates with wipers on the casing side. As such, this shield compromises the machine efficiency and added expense of the machines.

SUMMARY OF THE INVENTION

According to the invention, a machine for the processing of optical work pieces, for example plastic spectacle lenses, has an adjusting mechanism with a linear drive unit and a swivel drive unit that are stacked on each other. The swivel drive unit can rotate the work piece spindle about a swivel axis that is substantially perpendicular to the work piece rotation axis and the linear drive unit can move the work piece spindle along a linear axis that is substantially perpendicular to one of the swivel axis and the work piece rotation axis and substantially parallel to the other of the swivel axis and the work piece rotation axis.

In one embodiment, the linear axis is substantially perpendicular to the swivel axis and substantially parallel to the work piece rotation axis B, is preferred since it makes possible the modular design of a machine with several processing units at minimal costs. In a second embodiment, the linear axis is substantially parallel or aligned with to the swivel axis and substantially perpendicular to the work piece rotation axis to have a large number of degrees of freedom of work piece movement. The second alternative is entirely suitable for the construction of a fast-tool lathe, in which the tool has a position controlled (infeed) axis anyway, which can compensate in the majority of processing cases for the lack of a corresponding movement possibility on the side of the work piece. For the construction of a milling machine however the first alternative may be preferred, because it eliminates the need of an additional position controlled linear axis on the tool side.

There are several advantages of the invention as compared to the present state of the art by having one of the linear axes on the side of the work piece is substituted by a swivel axis. Firstly, the swivel drive unit can be more easily closed or sealed off with a shield in comparison to the known linear drive unit. In other words, the parts of the swivel drive unit that do not protrude into the work space of the machine can be separated and/or isolated easily from the work space, for example by suitable rotary transmissions, sealing arrangements with commercially available lip seals and provisions for applying compressed air can all be produced at standards that ensure minimal wear and friction at the swivel drive unit.

Further, according to the invention, the machine has a very compact build due to the stacked arrangement of the linear drive unit and the swivel drive unit. Long movement paths, which are required for the X-axis in the generic state of the art for the sale purpose to be able to encounter the individual processing units, are eliminated. This also leads to quicker processing, particularly from a reduction in the auxiliary processing times, because the parts of the machine on the side of the work piece travel over shorter distances as compared to the present state of the art.

Furthermore, the stacked arrangement of the linear drive unit and the swivel drive unit enables the respective guideways to be arranged very closely together, which leads to a high rigidity of the adjusting mechanism. This is also beneficial to a high processing quality.

Moreover, the present invention allows for a very flexible modular design, wherein different processing units, handling units, measuring stations and the like can be chosen in the manner of an assembly of prefabricated machine parts and can be arranged around the adjusting mechanism depending on the respective processing requirements. And last but not least, the present invention is advantageous from an ergonomical point of view; e.g. the individual machine parts can be easily arranged to ensure optimum accessibility for assembly, maintenance and setting operations.

In one embodiment, it is possible to arrange the linear drive unit and the swivel drive unit in such a way that the swivel drive unit sits on the linear drive unit or is supported by the latter to obtain the above-discussed second alternative, in which the linear axis is substantially parallel or aligned to the swivel axis and substantially perpendicular to the work piece rotation axis. The linear drive unit is aligned relative to a lathe unit in such a way that it can generate a relative feed movement between work piece and lathe tool in the direction of the work piece rotation axis (radial feed). In this case the swivel drive unit could in particular serve the exchange of work pieces. In another embodiment however, the linear drive unit is arranged on the swivel drive unit in order to obtain more flexibility with regard to the possible machine build-up stages that require less construction space and more easily seals off and the linear drive unit.

In one embodiment, it is also preferred that the swivel drive unit can rotate the work piece spindle about the swivel axis with control of the rotation angle, i.e. in an angular position controlled manner. If the swivel drive unit however is mainly used for the exchange of work pieces, as described above, it can be sufficient to merely provide for a swivel motion of the work piece spindle against end stops without control of the rotation angle, instead of a CNC-controlled swivel axis.

In a very compact and rigid embodiment of the machine, the swivel drive unit may include a swing table on which are mounted parallel guide rails for a Y-slide of the linear drive unit. A linear motor is arranged between the guide rails by means of which the Y-slide can be moved relative to the swing table. In addition, such guide systems and linear motors are economically available in the market place.

Furthermore, it is preferred that the swivel drive unit has a torque motor in order to generate the swivel movement about the swivel axis. This eliminates the need for a gearing system to generate the rotation dispensable, so a gear backlash is avoided. In this embodiment, a high and reproducible precision of the swivel movements and the angle setting of the work piece spindle about the swivel axis is achieved.

It is mentioned from the beginning that the inventive machine concept is so flexible, that in one embodiment, the at least one processing unit may include a lathe unit with a fast-tool arrangement and/or a milling unit with a tool spindle, wherein the most modest type of the machine only contains one of those processing units.

In one embodiment, it is preferred that the adjusting mechanism that carries the work piece spindle is arranged at a central part of the machine body, while the at least one processing unit, a loading/unloading station for loading, unloading work pieces and at least one further unit or station are arranged in a star shape for example cross-wise, X-or Y-shaped, or at different angles with respect to the swivel axis about the adjusting mechanism. The at least one further unit or station is chosen from a group containing the following units and/or stations: a lathe unit with a fast-tool arrangement, a milling unit with a tool spindle, an engraving station for marking the work piece and a measuring station for measuring the work piece.

One of the possible embodiment constructions of the machine may have two lathe units as processing units, each having a fast-tool arrangement. It is advantageous to arrange the fast-tools at positions opposite to each other in relation to the adjusting mechanism, so that the work directions of the fast-tool arrangements and the swivel axis are substantially in the same plane. This way the fast-tool arrangements can be driven so for instance, that one of the fast-tool arrangements oscillates, i.e. reciprocates while machining one rotating work piece while the other fast-tool arrangement in relation to the swivel axis oscillates in the opposite direction with respect to the first fast-tool arrangement, to prevent an excessive oscillatory excitation of the machine body by oscillatory compensation.

Furthermore, it is preferred that the work direction of the fast-tool arrangement of the at least one lathe unit is tilted relative to a plane that is substantially perpendicular to the swivel axis, so that the fast-tool arrangement, viewed from the adjusting mechanism, slopes downwardly in the radial outward direction. The mentioned tilt of the fast-tool arrangement firstly allows for a very precise height adjustment of the cutting edge of the lathe tool that is fixed to the fast-tool arrangement in relation to the work piece rotation axis, without the necessity to adjust the height of the lathe tool cutting edge in relation to the fast-tool arrangement. This arrangement eliminates the need for mechanical adjustment systems or the like for the height adjustment of the lathe tool. The amount of feed movement of the work piece spindle in the direction of its axis and thus the height compensation between the work piece rotation axis and the work point of the lathe cutting edge achieved therewith, is provided according to the sine function of the pre-determined angle between the plane that is perpendicular to the swivel axis and the work direction of the fast-tool arrangement. The tilt of the fast-tool arrangement that slopes off in the radial outward direction, provides the advantage that the lathe tool can withdraw in a retracted position with respect to the work space of the machine when the electricity is turned off of the fast-tool arrangement, and remains there in a de-energized state of the fast-tool arrangement, thus reducing the risk that the machine operator cuts himself on the very sharp lathe cutting edge during setting operations or the like in the workspace of the machine.

In accordance with another aspect of the invention, a covering hood can be mounted to a swing table of the swivel drive unit, that covers the work piece spindle and the linear drive unit at the same time, which has the advantage that no separate sealing or protective measures are necessary.

In this embodiment, the covering hood can have an opening through which the work piece spindle moveably extends, wherein a bellows is arranged between an inner circumference of the opening and an outer circumference of the work piece spindle, that seals off the inside of the covering hood from the work space of the machine. Such a bellows is economical, seals off sufficiently, is resistant to wear and offers very little resistance only to the linear movements of the work piece spindle.

In this context it is also an advantage if the work piece spindle has an aerostatic bearing. The exhaust air of such a bearing at the same time acts namely as blockage air that prevents that cooling lubricant or the like to enter into the covering hood or the work piece spindle from the work space of the machine through possible gaps or slits.

In another preferred embodiment of the invention, a machine upper part that can be pivoted in relation to the machine body can be provided for, that limits the work space of the machine together with the machine body, wherein the machine upper part has a lower substantially annular, cylindrical edge that positively engages into an assigned substantially annular recess in the machine body when the machine upper part is closed. In this way it is possible on the one hand to open up the entire workspace of the machine for maintenance, repair and/or setting operations by swinging up the upper part of the machine, which makes the respective machine parts highly accessible, while on the other hand the machine upper part when lowered down reliably seals or closes off the work space from the surroundings by engaging with the machine body as described above.

The machine body is preferably formed from a solid block of polymer concrete also known as mineral casting. This material, which is a composite material, comprising a mineral filler mixture and a bonding material on a reaction resin basis, has a high mass and also a low thermal expansion coefficient, is very rigid and has good damping characteristics that avoids the disturbing transfer of vibrations generated by the fast-tool arrangement via the machine body onto the adjusting mechanism and thus onto the work piece spindle.

BRIEF DESCRIPTION OF THE DRAWINGS

In the following the invention will be further explained, using a preferred embodiment example, with reference to the enclosed partially schematic drawings, in which the same numerals represent the same or similar parts. In the drawings.

DETAILED DESCRIPTION OF THE PREFERRED EMBODIMENT

Figure 1:
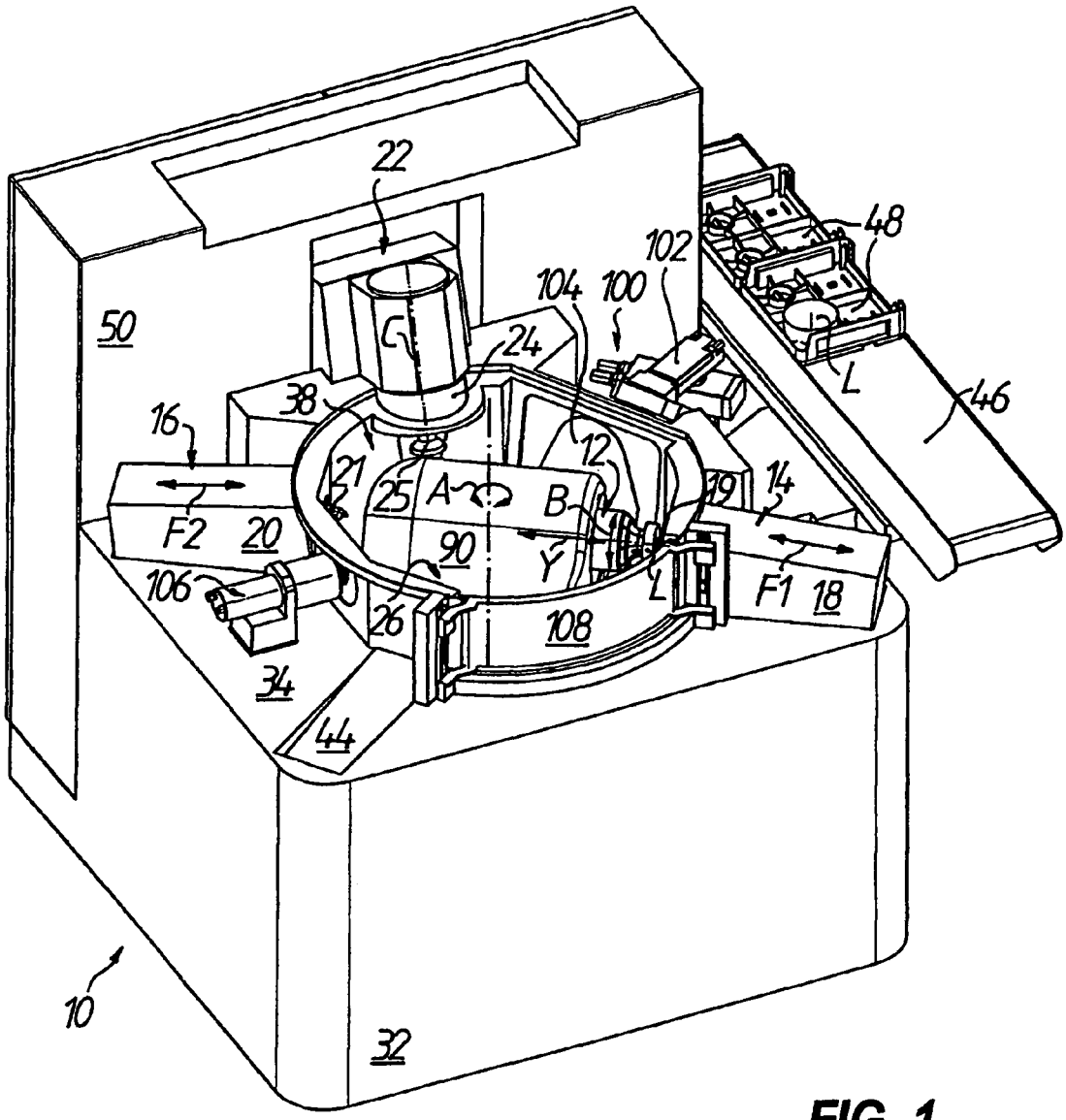
FIG. 1 is a perspective view of a machine according to one embodiment of the invention for the processing of optical work pieces in particular of plastic spectacle lenses, from an angle in front of and above the machine, without the upper part of the machine (which is removed to allow for a better view on the inside of the machine), the tool equipment of which includes a milling unit with a tool spindle and two lathe units with each one fast-tool arrangement.

In FIGS. 1 to 4, 7, 9 and 10 a CNC-controlled machine in particular for processing the surface of plastic spectacle lenses L in indicated with 10. The machine 10 has in general (a) a work piece spindle 12 by means of which the spectacle lens L can be driven rotationally about a work piece rotation axis B, (b) at least one, in the example of embodiment shown even three processing units for machining the spectacle lens L that is retained on the work piece spindle 12, namely two lathe units 14, 16 each comprising a fast-tool arrangement 18, 20 for causing a linear movement in the direction F1 or F2 of a lathe tool 19, 21 respectively assigned as the tool, as well as a milling unit 22 with a tool spindle 24 for causing a rotational movement of a milling tool 25 about a tool rotation axis C, and (c) an adjusting mechanism indicated in general with 26 for causing a relative movement between the work piece spindle 12 and the respective tool 19, 21, 25 in order to (at least) be able to selectively load, unload or process the spectacle lens L.

It is essential, as will be further made clear hereafter, that the adjusting mechanism 26 has a linear drive unit 28 as well as a swivel drive unit 30 (see FIGS. 3 to 6), that are stacked on each other, wherein the work piece spindle 12 can be pivoted by means of the swivel drive unit 30 about a swivel axis A that is substantially perpendicular to the work piece rotation axis B, while the work piece spindle 12 can be moved by the linear drive unit 28 along a linear axis Y that, in the example of embodiment shown, is substantially perpendicular to the swivel axis A and substantially parallel to the work piece rotation axis B.

Figure 2:
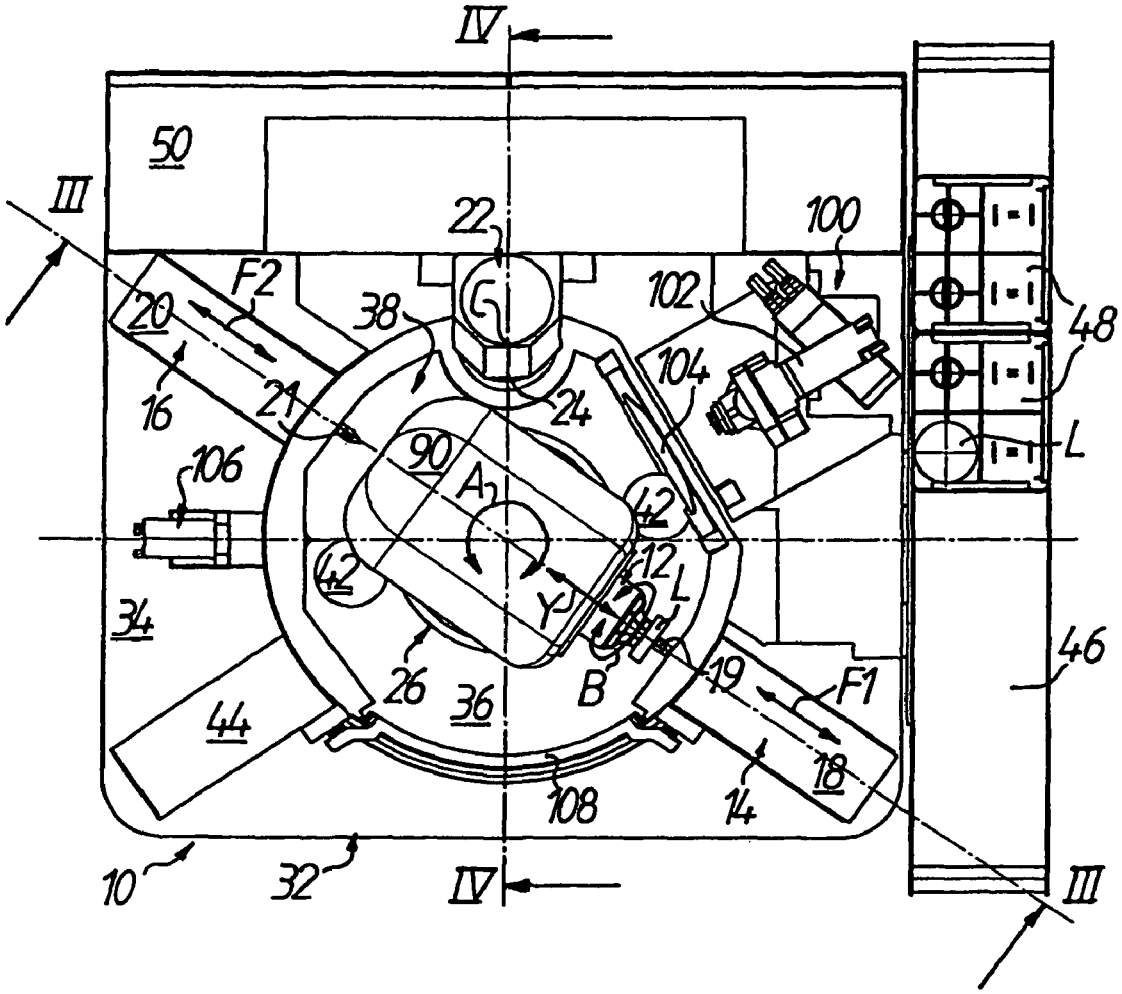
FIG. 2 is a plan view of the machine according to FIG. 1 as seen from above the machine in FIG. 1.

The machine 10 contains a solid machine body 32 made from polymer concrete, which starting from the upper side 34 is provided with a ring-shaped channel like clearance 36, that limits a work space 38 of the machine 10 from below and from the side. In the center of the clearance 36 a bearing hole 40 for the adjusting mechanism 26 is provided. In FIG. 2 two drains 42 for the removal of coolant and waste chips can be seen in the bottom of the clearance 36 that are arranged diametrically opposed with respect to the bearing hole 40. Starting from the upper side 34 several flange facings 44 are embedded in the machine body 32 in a star shaped arrangement around the clearance 36, which serve to mount the processing units 14, 16, 22 and further units or stations. Furthermore, FIGS. 1 and 2 show a transport device 46 for the transport of job trays 48 that is mounted along the machine body 32, in which job trays the spectacle lenses L that need to be processed or have been processed can be transported. Finally, a control cabinet 50 is also mounted on the machine body 32, that contains the necessary control and supply subassemblies.

In FIGS. 3 to 6 details of the adjusting mechanism 26 can be seen. First of all it can be seen that the linear drive unit 28 is arranged on top of the swivel drive unit 30. The latter is mounted in the bearing hole 40 of the machine body 32 by means of a bearing flange 52 that is divided in two and comprises a lower part 54 and an upper part 56.

The swivel drive unit 30 has a torque motor 58, that is, just like all the other main drives of the machine 10, cooled with water (not shown) and serves to pivot the work piece spindle 12 about the swivel axis A with CNC-control of the rotation angle. According to FIGS. 5 and 6 the stator 60 of the torque motor 58 is fixed in the lower part 54 of the bearing flange 52. The rotor 62 of the torque motor 58 is pivoted in the lower part 54 of the bearing flange 52 by a combined axial/radial needle bearing arrangement 64. As an alternative an aero-or hydrostatic bearing could also be used for the rotor 62.

Between the lower part 54 and the upper part 56 of the bearing flange 52 an annular travel measuring system 66 is provided, which encircles the rotor 62 of the torque motor 58 which detects the angular position of the rotor 62 in relation to the stator 60 for the angular position control of the torque motor 58. As an alternative to this, a hollow shaft rotary encoder could also be considered.

Above the upper part 56 of the bearing flange a swing table 68 is mounted to the rotor 62 of the torque motor 58, wherein gaskets 70 are provided between the swing table 68 and the fixed upper part 56 of the bearing flange 52, which seal off the swivel drive unit 30 against the work space 38 of the machine. In addition to this, one can provide for the supply of compressed air (not shown), which also avoids coolant leaking into the swivel drive unit 30.

It remains to be noted about the swivel drive unit 30 that all electric and signal cables as well as air and coolant tubes (not shown) are run through the hollow shaft of rotor 62 to reach the subassemblies that are mounted on the swing table 68.

Figure 5:
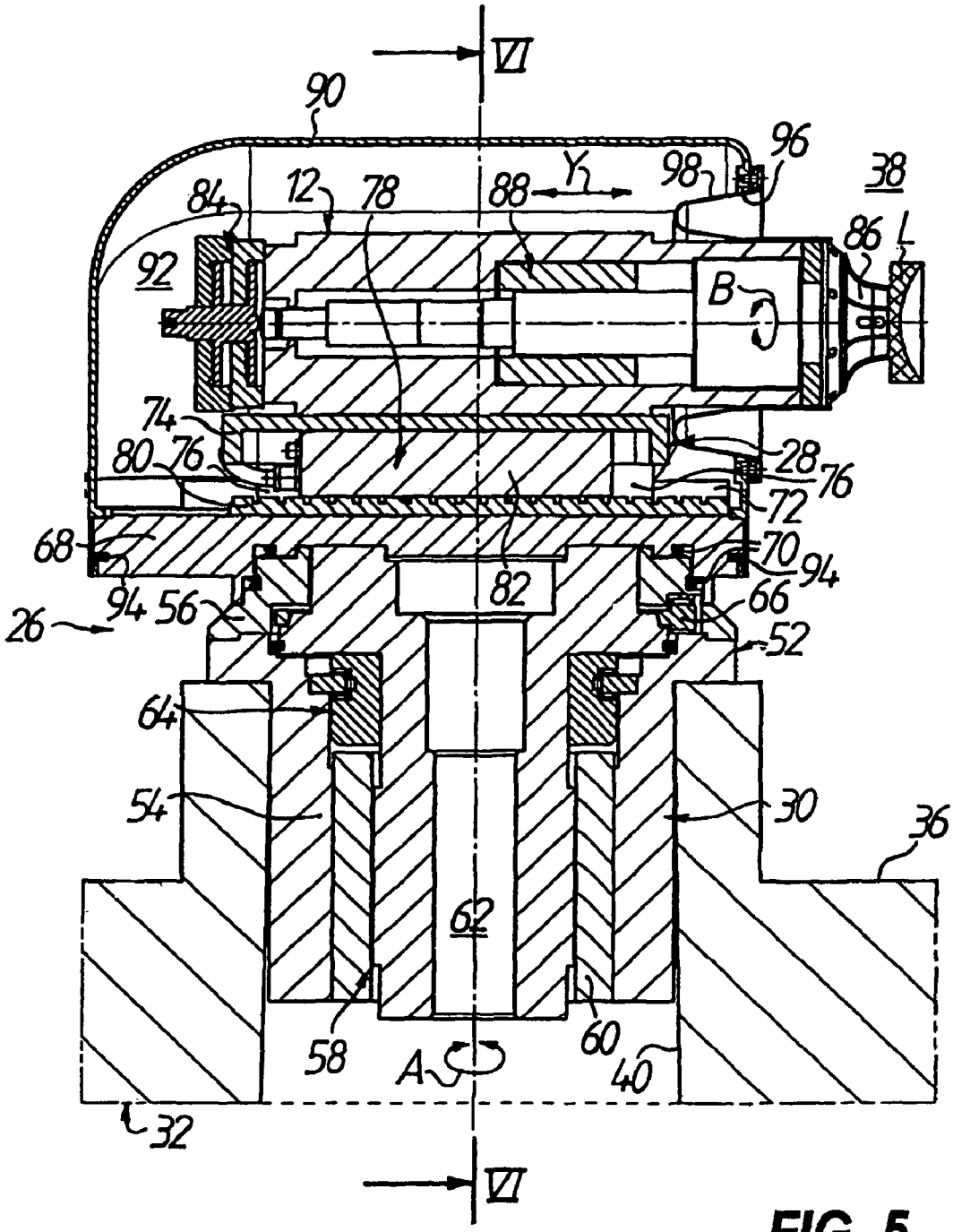
FIG. 5 is a part of a longitudinal section, proportionally enlarged from the sections as in FIGS. 3 and 4, of a central adjusting mechanism supporting a work piece spindle of the machine according to FIG. 1, that comprises a swivel drive unit and a linear drive unit arranged thereon.
Figure 6:
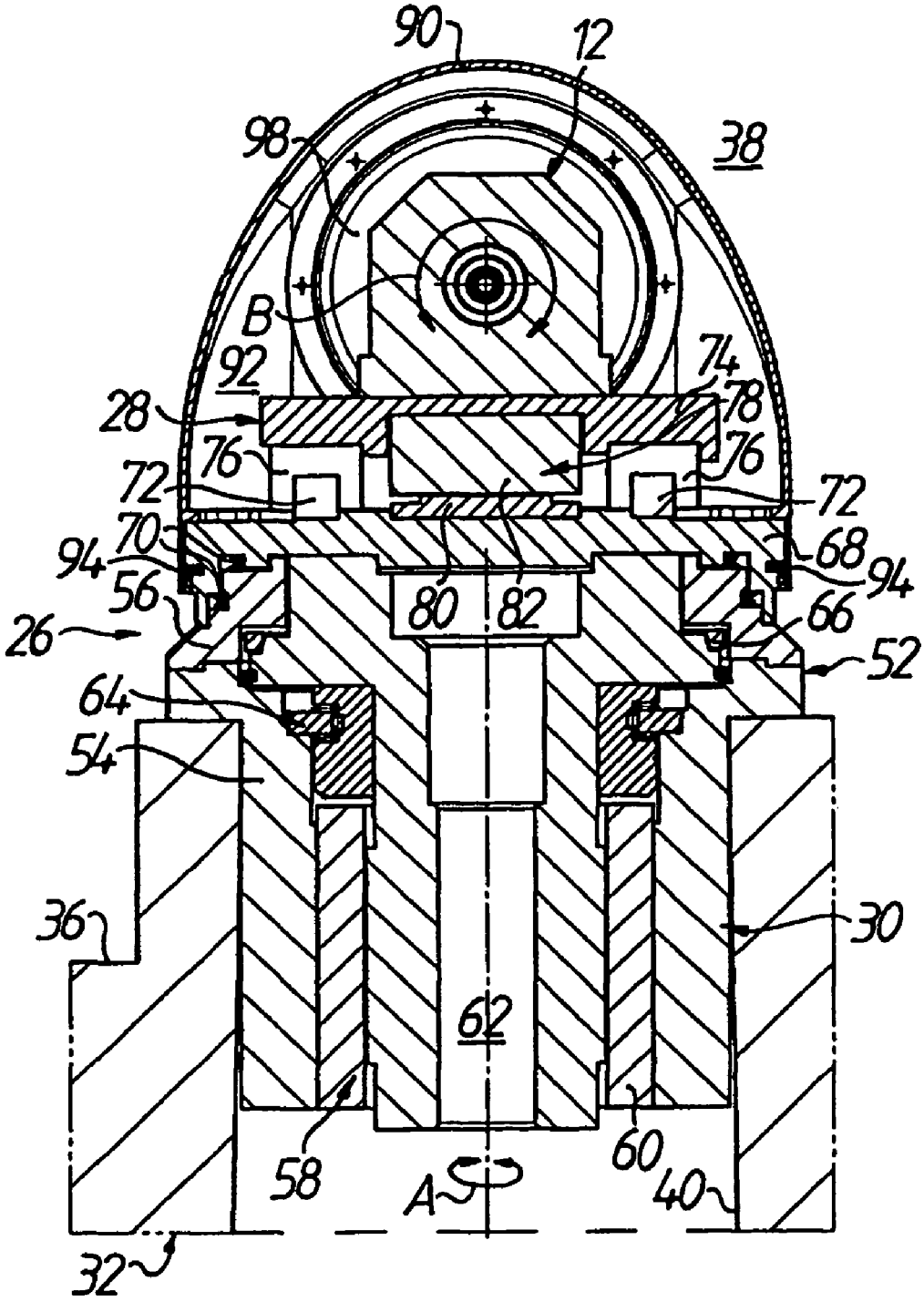
FIG. 6 is a part of a section of the central adjusting mechanism supporting the work piece spindle of the machine according to FIG. 1 along line VI-VI in FIG. 5.

In particular FIGS. 5 and 6 further disclose two guide rails 72 for a Y-slide 74 of the linear drive unit 28 are mounted in a parallel arrangement on swing table 68. Here the Y-slide 74 is slideably guided on the guide rails 72 by four guide carriages 76 in total, and in particular in the vicinity of the axial/radial needle bearing arrangement 64 of the swivel drive unit 30.

Between the guide rails 72 a linear motor 78 is arranged which can move and adjust the Y-slide 74 relative to the swing table 68, and in particular CNC position control the Y slide in both directions of the Y-axis (the assigned travel measuring system is not represented for simplification). The stator 80 of the linear motor 78 is fixed to the swing table 68, the slide/runner 82 of the linear motor 78 is mounted to the Y-slide 74, to which in turn the work piece spindle 12 is fixed.

The work piece spindle 12 is known per se and thus does not need any further description here. It has to be mentioned however, that the work piece spindle 12 has an aerostatic bearing (not shown), the exhaust air of which advantageously contributes to the sealing off relative to the work space 38, and is equipped with a dual piston-cylinder arrangement 84 for the operation of a clamping chuck 86 (see FIG. 5). The chuck 86 blocks the spectacle lens L onto a block piece (not shown) which in turn is clamped to the work piece spindle 12. With the aid of the electric motor 88 of the work piece spindle 12, finally the spectacle lens L can be driven rotationally about the work piece rotation axis B with the angular position being CNC-controlled (the assigned travel measuring system is again omitted to simplify the drawing).

It can be seen in particular in FIGS. 3 to 6, that a covering hood 90 is attached to the swing table 68 of the swivel drive unit 30. The hood 90 covers both the work piece spindle 12 and the linear drive unit 28. The inside 92 of the covering hood 90 in relation to the work space 38 of the machine 10 is sealed off by sealing profiles 94 which are arranged between the covering hood 90 and the swing table 68. On the right-hand side in FIG. 5 the covering hood 90 has an opening 96, through which the work piece spindle 12 moveably extends, so that the clamping chuck 86 with the spectacle lens L clamped to it is located in the work space 38 of the machine 10. Between an inner circumference of the opening 96 and an outer circumference of the work piece spindle 12 a bellows 98 is arranged, which is suitably fixed to the work piece spindle 12 and the covering hood 90 and has the function to seal off the inside 92 of the covering hood 90 in relation to the work space 38 of the machine 10.

From the above description it is therefore apparent that the work piece spindle 12 can be moved with CNC position control (A-axis, Y-axis) in a plane that is perpendicular to the swivel axis A, by the adjusting mechanism 26 that includes the linear drive unit 28 and the swivel drive unit 30. The spectacle lens L can be rotated about the work piece rotation axis B with the rotation angle being CNC position controlled (B-axis). Thus, the spectacle lens L can be transferred from one processing unit or the like to the next processing unit or the like (A-axis), can be moved transversely with respect to one processing unit or the like (A-axis, possibly combined with the Y-axis, in particular for feed movements), and/or can be moved relatively to one processing unit or the like in the direction towards or away from it (Y-axis, in particular for infeed movements). This concept does not only result in a very compact design of the machine 10, but also in an increased precision in processing when compared to a system with a cross slide arrangement to move the work piece spindle, which needs relatively longer linear guides.

Figure 3:
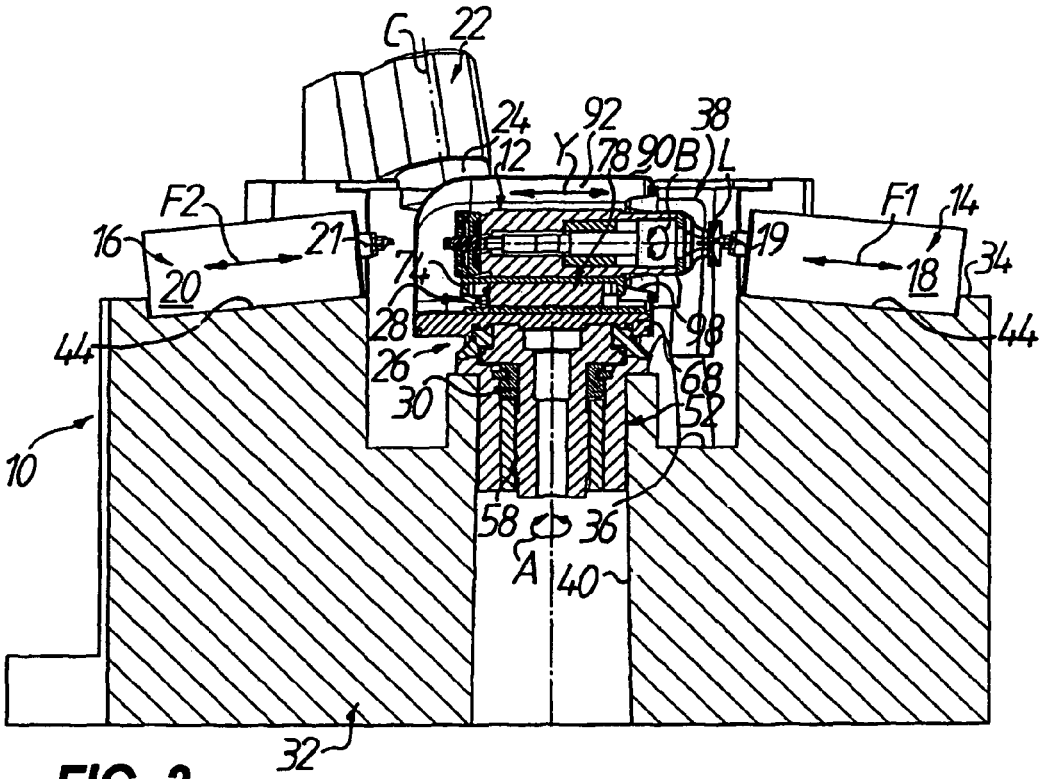
FIG. 3 is a partial section of the machine according to FIG. 1 along line III-III in FIG. 2, in which to simplify the representation as compared to FIGS. 1 and 2 a control cabinet and a transport device of the machine are not shown.

In particular FIGS. 1 and 2 show just various units and stations that are arranged in a star shape around the adjusting mechanism 26 which is provided at a central location in the machine body 32 and carries the work piece spindle 12. In FIGS. 1 to 3 the work piece spindle 12 faces the lathe unit 14. On the side of the machine body 32 that is diametrically opposite with respect to the adjusting mechanism 26 the lathe unit 16 is located, so that the work directions F1, F2 of the opposed positioned fast-tool arrangements 18, 20 and the swivel axis A are substantially in the same plane, what can be used by a suitable control of the fast-tool arrangements 18, 20 for oscillatory compensation. The internal design and the function of the here presented fast-tool arrangements 18, 20 are described in more detail in commonly owned document U.S. 2007/0094857, which is expressly incorporated by reference to in this context to avoid repetitions.

In FIG. 3 it can be seen in particular, that the flange facings 44 provided on the machine body 32 for the fast-tool arrangements 18, 20 are tilted, so that they, starting from the work space 38 of the machine 10, slope downwardly in the radial outward direction. This leads to the fact that the work directions F1, F2 of the fast-tool arrangements 18, 20 which are mounted on the flange facings 44, are correspondingly tilted relative to a plane which extends substantially perpendicular to the swivel axis A. The reason and function of this tilt are described in commonly owned document U.S. Publication 2006/0260447 by the same applicant, which is expressly incorporated by reference to in this context to avoid repetitions. Because of the cant or tilt of the flange facings 44 for the fast-tool arrangements 18, 20 in relation to the work space 38 it is further achieved that the lathe tools 19, 21 in the de-energized state of the fast-tool arrangements 18, 20 withdraw into positions that are retracted in relation to the work space 38 and remain in those.

According to in particular FIGS. 1 and 2, and seen in counter-clockwise direction about the swivel axis A a loading/unloading station 100 follows after the lathe unit 14 for loading or unloading spectacle lenses L into or from the machine 10. The loading/unloading station 100 possesses a loading mechanism 102, that is so adapted with regard to its degrees of freedom in movement and its gripping capabilities, that it can take a spectacle lens L out of a job tray 48 and put it in the work space 38 of the machine 10 after opening of a door 104 provided on the machine body 32, to clamp the blocked spectacle lens L on the work piece spindle 12, and vice versa.

Figure 4:
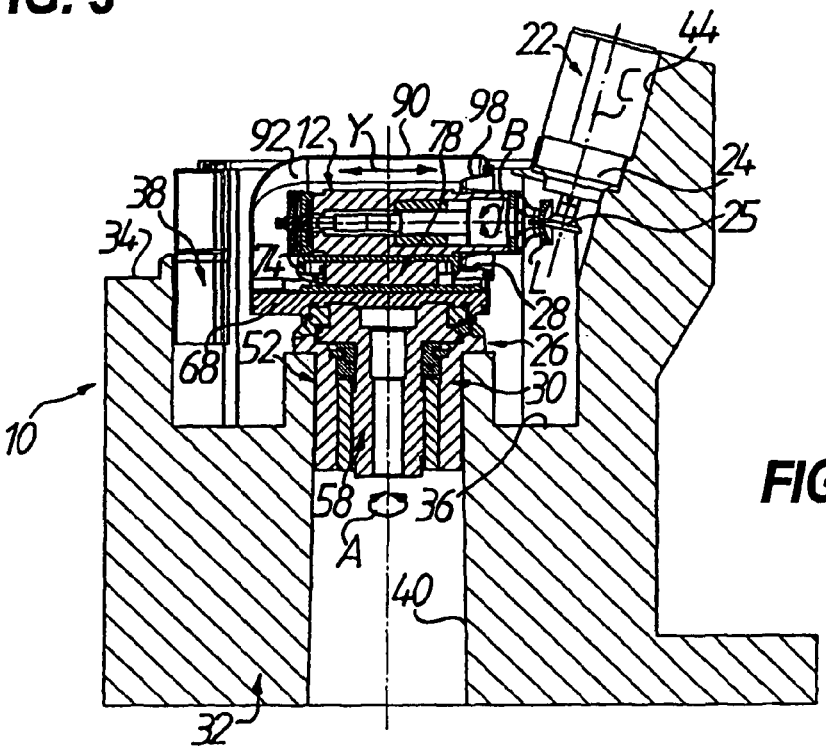
FIG. 4 is a partial section of the machine according to FIG. 1 along line IV-IV in FIG. 2, in which to simplify the representation as compared to FIGS. 1 and 2 a control cabinet of the machine are not shown.

After the loading/unloading station 100 follows, again seen in counter-clockwise direction about the swivel axis A, the milling unit 22 (see in particular FIG. 4, in which the work piece spindle 12 has been moved by the adjusting mechanism 26, that the spectacle lens L clamped on the work piece spindle 12 faces the milling unit 22 that is provided stationary on the machine body 32). Design and function of the milling unit 22 are described in more detail in commonly owned U.S. Pat. No. 5,938,381 which is expressly incorporated by reference to in this context to avoid repetitions.

After that follows the second lathe unit 16. This one corresponds in principle with the first lathe unit 14, but can be equipped with another lathe tool 21 according to the respective processing requirements, possibly also with an engraving tool, as described in the prior commonly owned U.S. Patent Publication 2007/0277357 which is expressly incorporated by reference to regarding the engraving or marking function.

To engrave or mark the spectacle lenses L another device could be used if that is so desired and/or required, for example a laser or an engraving tool, that is supported by an aerostatic bearing just like a feeler pin and is driven by means of a voice-coil drive, wherein the latter could be sized considerably smaller than the fast-tool arrangements 18, 20 described here. Such a device could for example be mounted to the still free flange facing 44 of the machine body 32 (see FIG. 1, front left and FIG. 2, below left).

Finally, seen in counter-clockwise direction about the swivel axis A, after the second lathe unit 16 follows a measuring station 106 for measuring the spectacle lenses L. In this case it is possible to use a shape detector known per se, with which the spectacle lens L can be measured in situ. It can also be envisaged to use devices for non-contact gauging, for example optical measurement of the spectacle lenses L. If such a measuring station 106 is present, it is possible to calibrate the machine 10—in particular its lathe units 14, 16—automatically, as described in more detail in commonly owned document U.S. Patent Publication 2006/0253220.

On the machine body 32 there could be provided also an additional cribbing-spindle with a milling tool projecting into the work space 38 to edge or pre-edge the spectacle lenses L (not shown), the rotation axis of which would preferably lie in the same plane as the work piece rotation axis B, as is known from commonly owned document U.S. Pat. No. 7,278,192.

Figure 7:
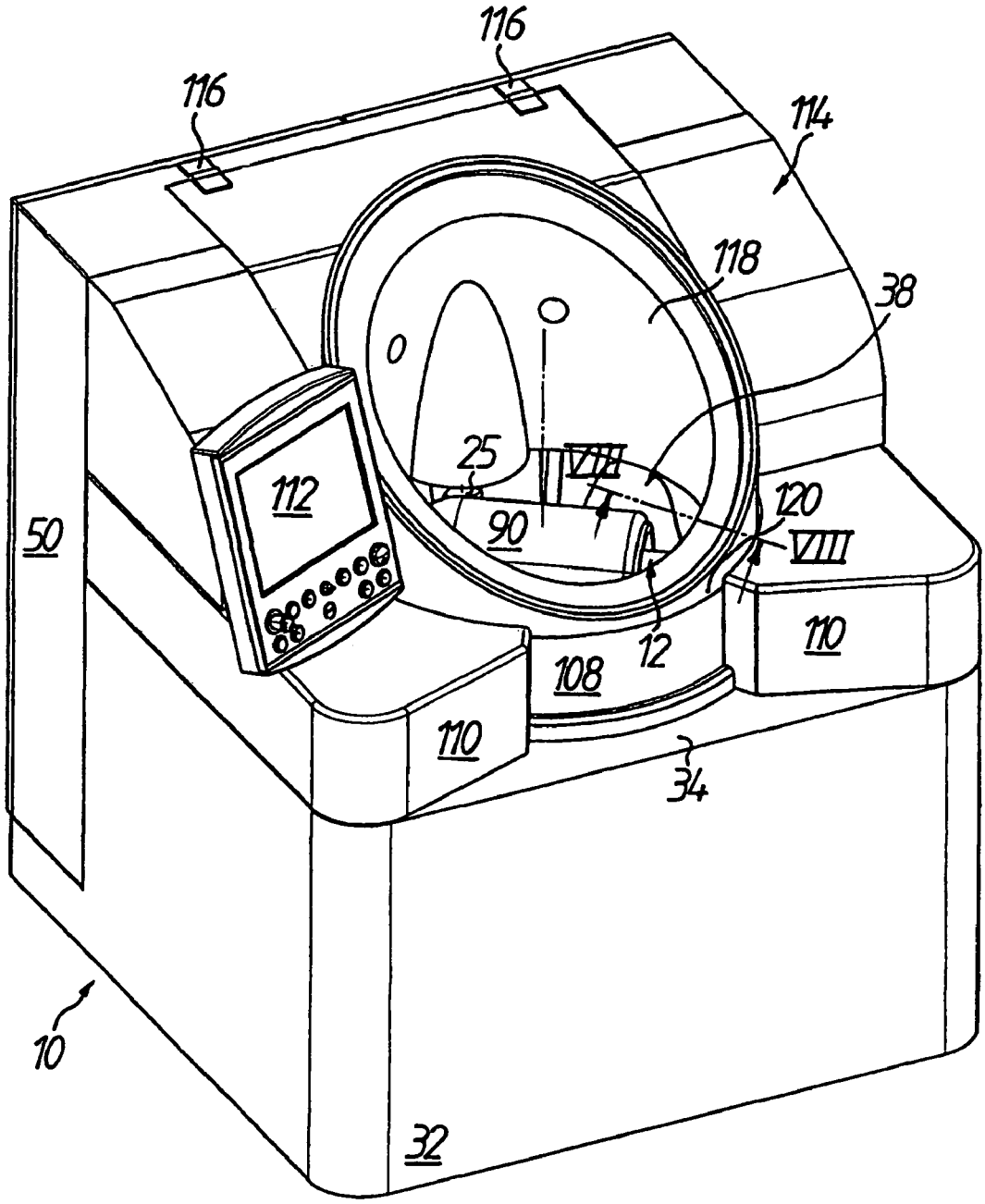
FIG. 7 is a perspective view of the machine according to FIG. 1 from an angle in front of and above the machine, with the machine upper part in a closed, lowered down position, in which to simplify the representation as compared to FIG. 1 a transport device of the machine has been left out.
Figure 8:
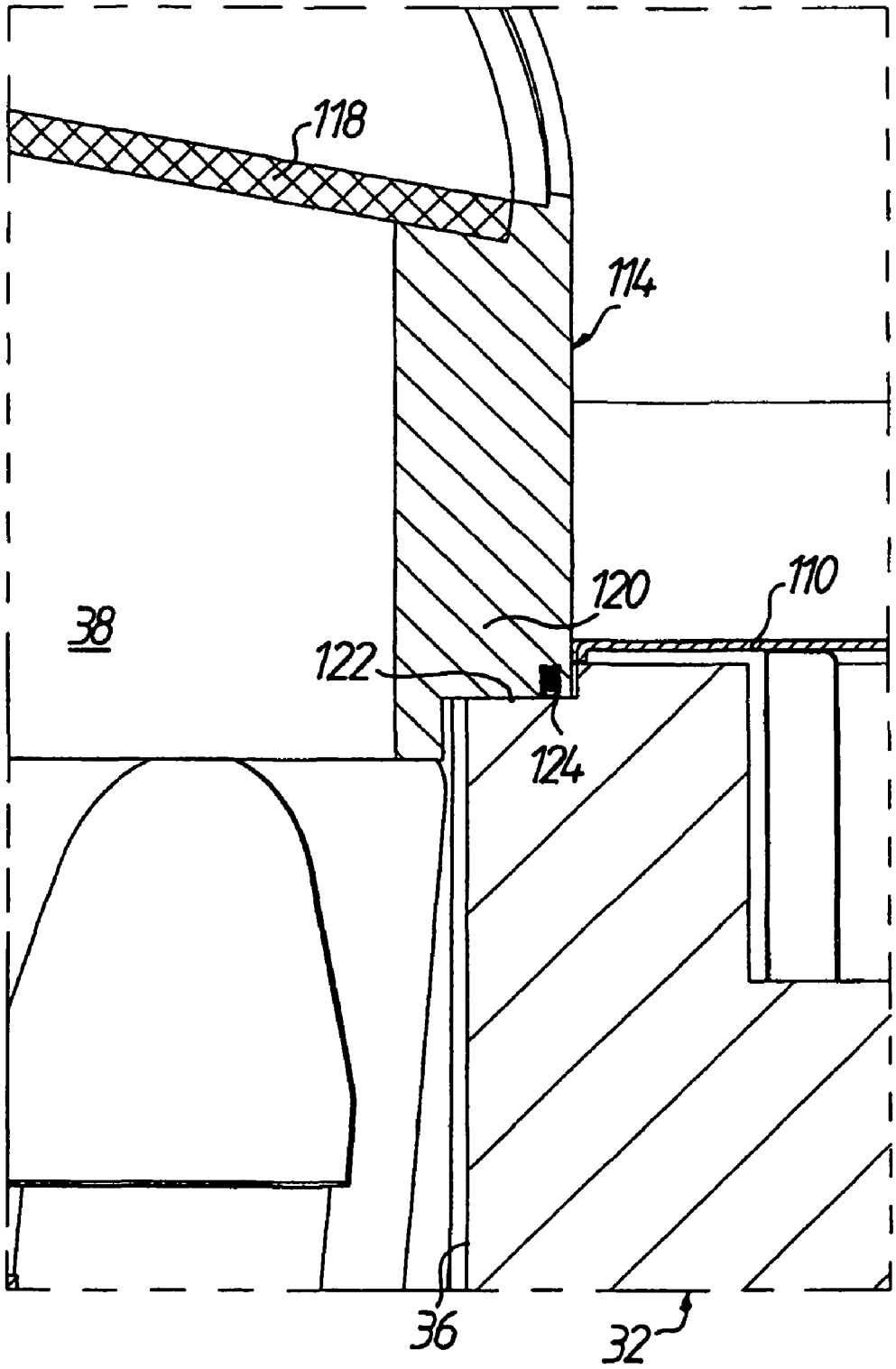
FIG. 8 is a proportionally enlarged, part section of the machine according to FIG. 1 along line VIII-VIII in FIG. 7 in an area where the machine body and the machine upper part are adjacent to each other.
Figure 9:
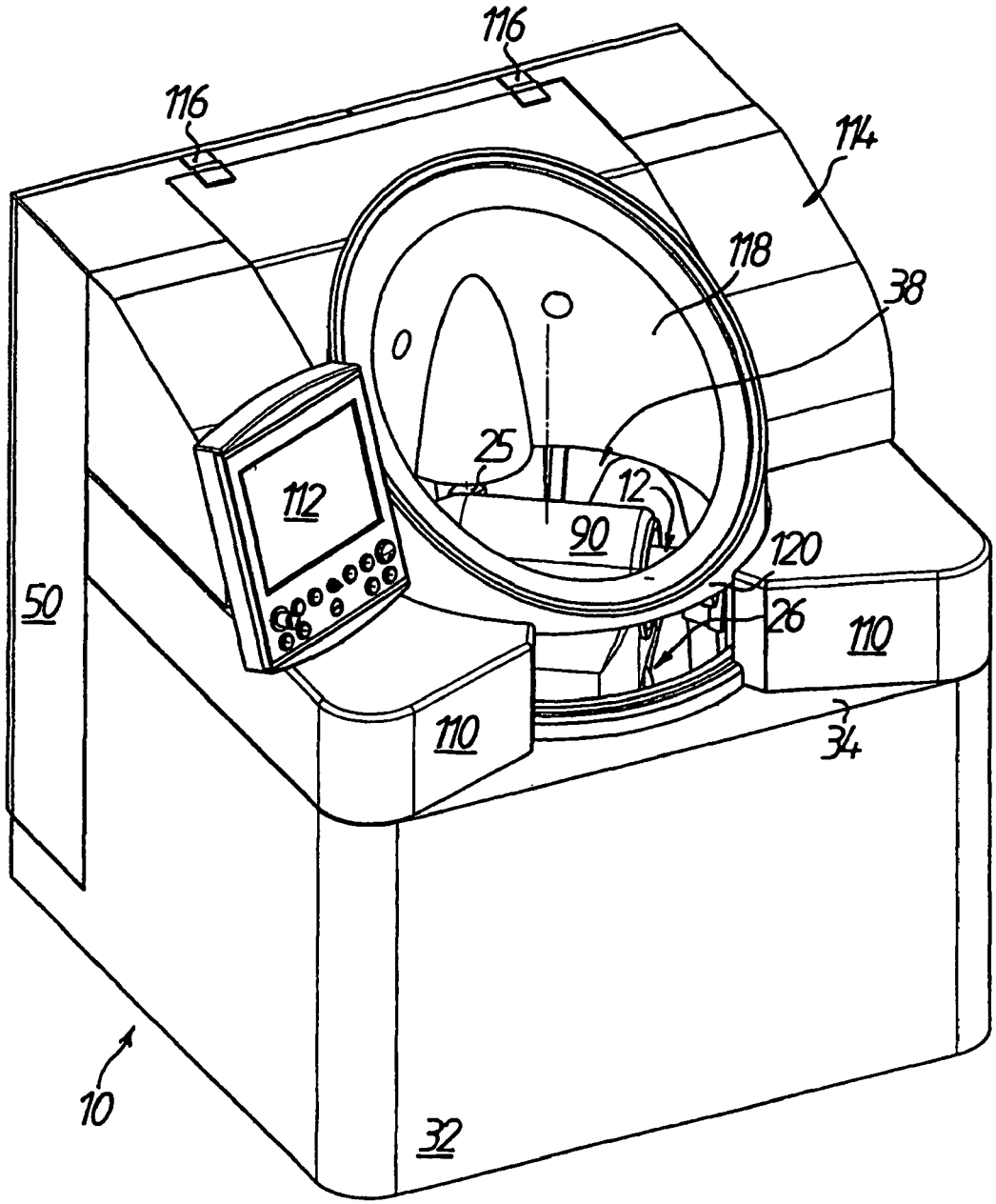
FIG. 9 is a perspective view from an angle in front of and above the machine according to FIG. 1, similar to the one in FIG. 7, in which a sliding door at the front of the machine that can be sunk into the machine body is open, in order to allow access to the work space of the machine by an operator.

Further details of the encapsulation of the work space 38 of the machine 10 can be taken from FIGS. 7 to 10. In the front of FIG. 7, 108 indicates a sliding door, that is suitably guided on the machine body 32 and can be sunk into it (see FIGS. 9 and 10), in order to allow access to the work space 38 of the machine 10 by an operator. Coverings 110 which are put on and attached to the machine body 32 cover in particular the lathe unit 14 and the measuring station 106; between the latter and the work space 38 a door that can selectively be opened and closed can be fitted as well (not shown), in order to protect the measuring station 106. An operation panel 112 with an integrated control screen is arranged on the left hand side covering 110 in FIGS. 7, 8 and 10.

Figure 10:
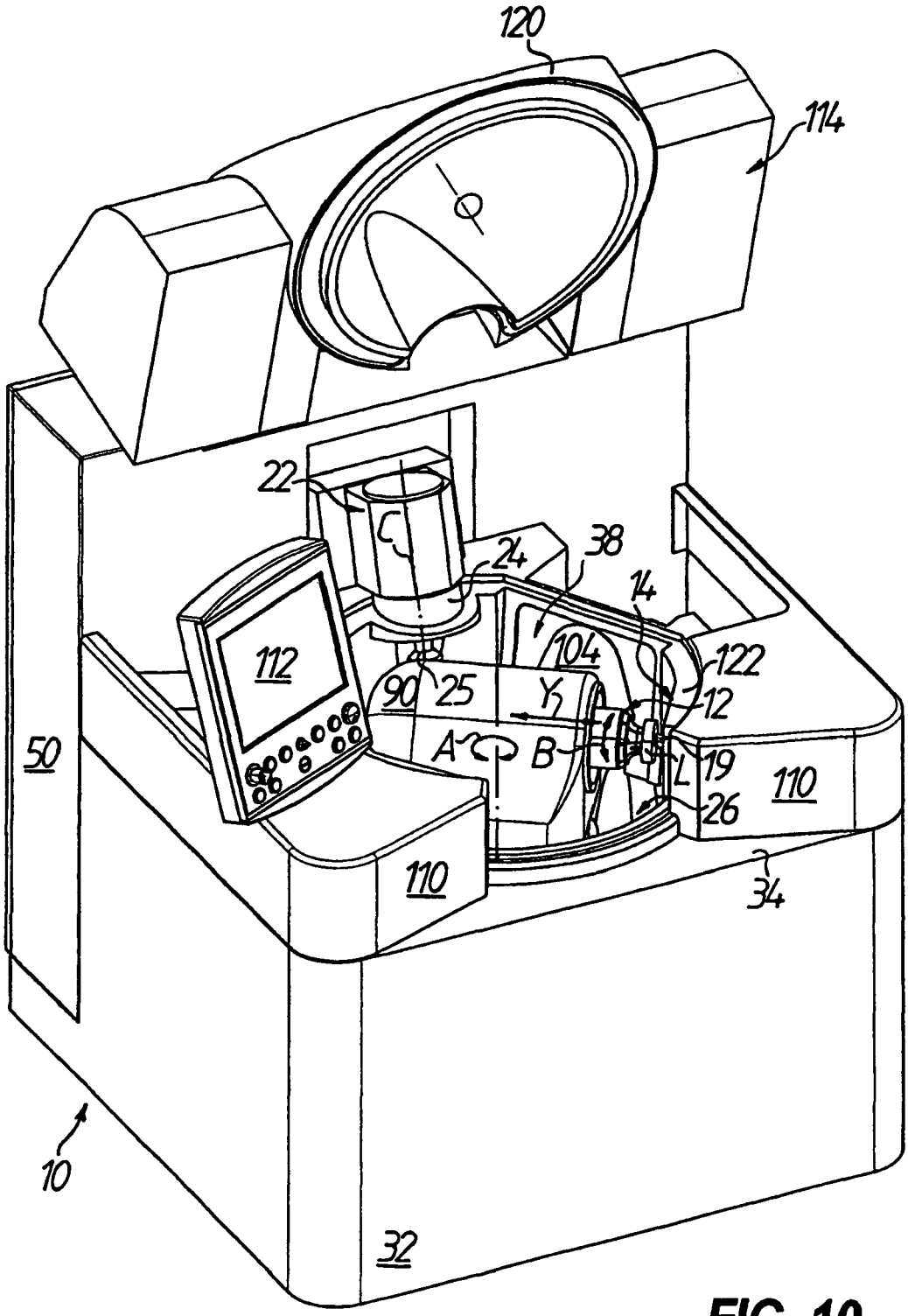
FIG. 10 is a perspective view from an angle in front of and above the machine according to FIG. 1, with the machine upper part that is in an open, raised up position, in which to simplify the representation as compared to FIG. 1 a transport device and a loading/unloading station of the machine have been left out.

Furthermore, the machine 10 has a machine upper part 114, which is hinged by means of hinges 116 in the area of the control cabinet 50 on the machine body 32 and can be pivoted relative thereto, in particular between a lower, closed position (FIGS. 7 and 9) in which the work space 38 of the machine 10 is hermetically closed, and an upper, opened position (FIG. 10). The machine upper part 114 has an elliptical window 118, which allows the operator an unencumbered view into the work space 38 of the machine 10 when the machine upper part 114 is in its closed position. The tilted installation of the window 118 ensures a functional drainage of the cooling lubricant that sprays against the inside of the window 118 during processing. According to FIG. 8, the machine upper part 114 finally has a lower substantially annular cylindrical edge 120 that engages positively into an assigned substantially annular recess 122 in the machine body 32 when the machine upper part 114 is closed. For further sealing, an encircling seal 124 can be arranged between the edge 120 of the machine upper part 114 and the assigned recess 122 in the machine body 32 (see FIG. 8).

In this fashion, a machine for the processing of optical work pieces is disclosed having a work piece spindle that drives rotationally the work piece about a work piece rotation axis (B). At least one processing unit has a tool with which the work piece can be machined, and an adjusting mechanism causes a relative movement between the work piece spindle and the tool to selectively enable loading, unloading and processing of the work piece. A special feature of one embodiment has the adjusting mechanism with a linear drive unit and a swivel drive unit that are stacked on each other. The work piece spindle can be rotated by the swivel drive unit about a swivel axis (A) that is perpendicular to the work piece rotation axis, while the work piece spindle can be moved by the linear drive unit along a linear axis (Y) that, preferably, is perpendicular to the swivel axis and parallel to the work piece rotation axis. As a result a very compact machine is provided in which especially the work space can be easily encased.

Other variations and modifications are possible without departing from the scope and spirit of the present invention as defined by the appended claims.

We claim

1. A machine for the processing of optical work pieces comprising:

a work piece spindle rotationally driving the work piece about a work piece rotation axis, at least two processing units that each comprise a tool for machining the work piece while the work piece is retained on the work piece spindle, and an adjusting mechanism for causing a relative movement between the work piece spindle and the tools, for enabling loading, unloading or processing of the work piece, the adjusting mechanism comprises a linear drive unit and a swivel drive unit that are stacked on each other with the linear drive unit mounted on the swivel drive unit, wherein the swivel drive unit can rotate the work piece spindle about a swivel axis that is substantially perpendicular to the work piece rotation axis to perform a transfer of the work piece from one of the processing units to another of the processing units, while the linear drive unit can move the work piece spindle along a linear axis that is substantially perpendicular to the swivel axis, and substantially parallel to or aligned with the work piece rotation axis, and wherein the at least two processing units include a processing unit having a drive for linearly moving the respective tool in a radial direction with respect to the swivel axis.

2. A machine as defined in claim 1 wherein:

the linear axis is arranged in a radial direction with respect to the swivel axis.

3. A machine as defined in claim 1, wherein the swivel drive unit can rotate the work piece spindle about the swivel axis with control of the rotation angle.

4. A machine as defined in claim 1, wherein:

the swivel drive unit comprises a swing table on which parallel guide rails for a Y-slide of the linear drive unit are mounted, wherein a linear motor is mounted between the guide rails for moving the Y-slide relative to the swing table.

5. A machine as defined in claim 1, wherein:

the swivel drive unit is operated by a torque motor.

6. A machine as defined in claim 1, wherein:

said drive for linearly moving the respective tool in the radial direction includes a fast-tool arrangement for oscillating a lathe tool.

7. A machine as defined in claim 1, wherein:

the adjusting mechanism that carries the work piece spindle is mounted at a central part of a machine body; and the at least two processing units, a loading/unloading station for loading or unloading work pieces and at least one additional station are arranged in star shape about the adjusting mechanism, wherein said at least one additional station is selected from a group containing the following: a lathe unit with a fast-tool arrangement, a milling unit with a tool spindle, an engraving station for marking the work piece and a measuring station for measuring the work piece.

8. A machine as defined in claim 1, wherein:

the at least two processing units each comprise a lathe unit having a fast-tool arrangement, the lathe units being arranged at positions opposite to each other in relation to the adjusting mechanism, so that the work directions of the fast-tool arrangements and the swivel axis are substantially in the same plane.

9. A machine as defined in claim 8 wherein:

the work direction of the fast-tool arrangements of the two lathe units are tilted relative to a plane that is substantially perpendicular to the swivel axis, so that the fast-tool arrangements, seen from the adjusting mechanism, slope off in the radial outward direction.

10. A machine according to claim 9 further comprising:

a covering hood mounted to a swing table of the swivel drive unit, which covers both the work piece spindle and the linear drive unit.

11. A machine according to claim 10 wherein:

the covering hood has an opening through which the work piece spindle moveably extends, wherein a bellows is arranged between an inner circumference of the opening and an outer circumference of the work piece spindle, that seals off the inside of the covering hood from the work space of the machine.

12. A machine according to claim 1, wherein:

the at least two processing units include a milling unit with a tool spindle.

13. A machine according to claim 1, wherein:

the adjusting mechanism that carries the work piece spindle is mounted at a central part of a machine body; the machine further comprising:

a machine upper part that can be pivoted in relation to the machine body and limits a work space of the machine together with the machine body, wherein the machine upper part has a lower substantially annular, cylindrical edge that engages positively into an assigned substantially annular recess in the machine body when the machine upper part is closed.

14. A machine according to claim 1 further comprising:

a machine body that is formed from a solid block of polymer concrete.

15. A machine as defined in claim 2, wherein:

the adjusting mechanism that carries the work piece spindle is mounted at a central part of a machine body; and the at least two processing units, a loading/unloading station for loading or unloading work pieces and at least one additional station are arranged in star shape about the adjusting mechanism, wherein said at least one additional station is selected from a group containing the following: a lathe unit with a fast-tool arrangement, a milling unit with a tool spindle, an engraving station for marking the work piece and a measuring station for measuring the work piece.

16. A machine as defined in claim 2, wherein:

the at least two processing units each comprise lathe units, each having a respective fast-tool arrangement, the lathe units being arranged at positions opposite to each other in relation to the adjusting mechanism, so that the work directions of the fast-tool arrangements and the swivel axis are substantially in the same plane.

17. A machine as defined in claim 16 wherein:

the work direction of the fast-tool arrangements of the two lathe units are tilted relative to a plane that is substantially perpendicular to the swivel axis, so that the fast-tool arrangements, seen from the adjusting mechanism, slope off in the radial outward direction.

18. A machine according to claim 1 further comprising:

a covering hood mounted to a swing table of the swivel drive unit, which covers both the work piece spindle and the linear drive unit.

19. A machine according to claim 18 wherein:

the covering hood has an opening through which the work piece spindle moveably extends, wherein a bellows is arranged between an inner circumference of the opening and an outer circumference of the work piece spindle, that seals off the inside of the covering hood from the work space of the machine.

* * * * *